United States Patent [19]

Ortwein et al.

[11] 4,266,719

[45] May 12, 1981

[54] TRACK MOUNTING ASSEMBLY AND SOUND-DAMPING SYSTEM THEREFORE

[75] Inventors: Hermann Ortwein, Cologne; Hans Braitsch, Bergisch Gladbach, both of Fed. Rep. of Germany

[73] Assignee: Clouth Gummiwerke Aktiengesellschaft, Cologne, Fed. Rep. of Germany

[21] Appl. No.: 52,974

[22] Filed: Jun. 28, 1979

[30] Foreign Application Priority Data

Jun. 30, 1978 [DE] Fed. Rep. of Germany ..... 2828713
Jul. 27, 1978 [DE] Fed. Rep. of Germany ..... 2832989

[51] Int. Cl.[3] ..... E01B 9/38; E01B 19/00

[52] U.S. Cl. ..... 238/283; 238/7; 238/109; 238/382

[58] Field of Search ..... 238/2, 5, 6, 7, 29, 238/30, 109, 115, 83, 84, 283, 382

[56] References Cited

U.S. PATENT DOCUMENTS

| | | | |
|---|---|---|---|
| 3,907,200 | 9/1975 | Bernard | 238/283 X |
| 4,208,011 | 1/1980 | Dahlhaus et al. | 238/283 X |

FOREIGN PATENT DOCUMENTS

| | | | |
|---|---|---|---|
| 1204697 | 11/1965 | Fed. Rep. of Germany | 238/283 |
| 1922055 | 11/1970 | Fed. Rep. of Germany | 238/283 |
| 1964039 | 8/1978 | Fed. Rep. of Germany | 238/2 |
| 331781 | 11/1935 | Italy | 238/115 |
| 52-51605 | 4/1977 | Japan | 238/283 |
| 200039 | 11/1965 | Sweden | 238/283 |
| 1033350 | 6/1966 | United Kingdom | 238/115 |

*Primary Examiner*—Randolph A. Reese
*Attorney, Agent, or Firm*—Montague & Ross

[57] ABSTRACT

A rail-mounting assembly in which a rigid member supporting the rail is received with clearance in an opening of an overlying rigid body. The clearance has downwardly and inwardly inclined flanks which bear upon a rubber-metal support damping sound, shock and vibration.

6 Claims, 9 Drawing Figures

Fig.1
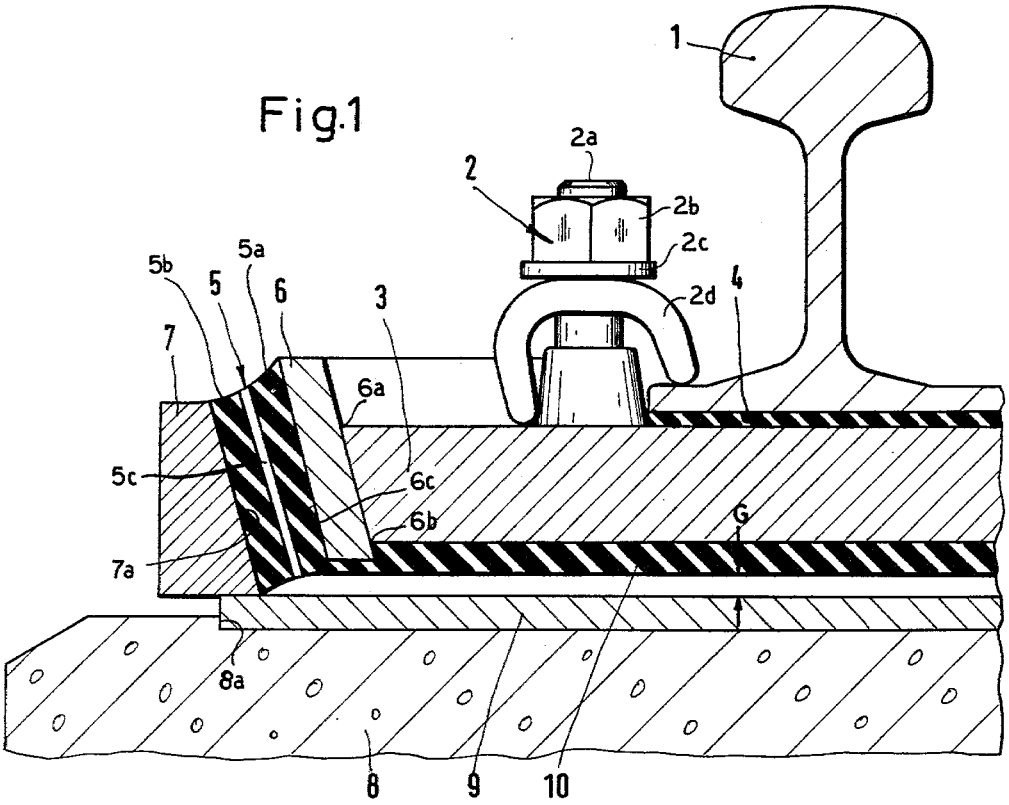
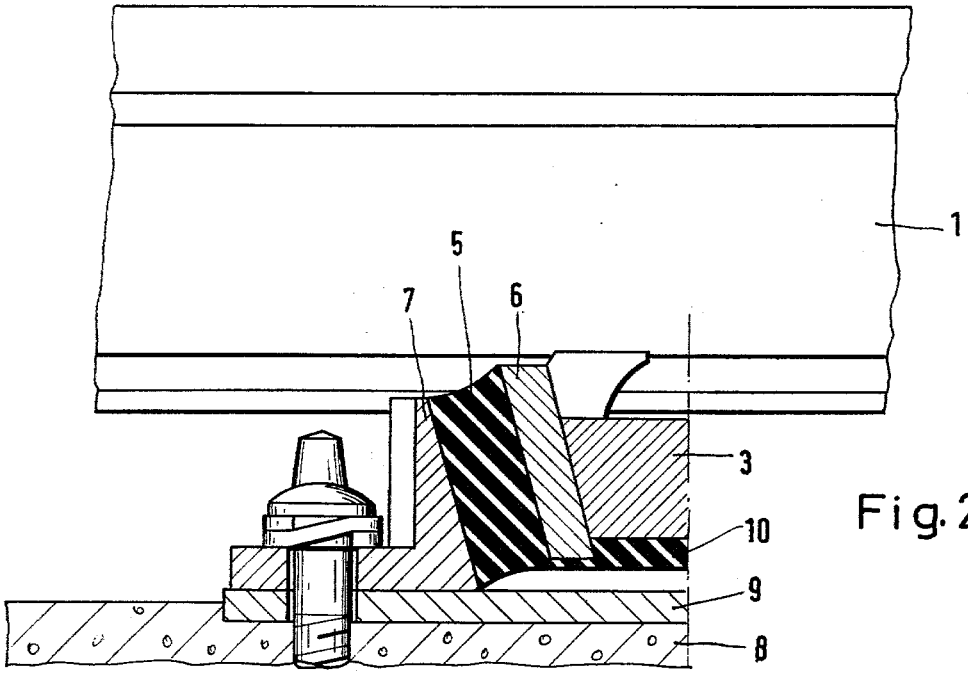
Fig.2

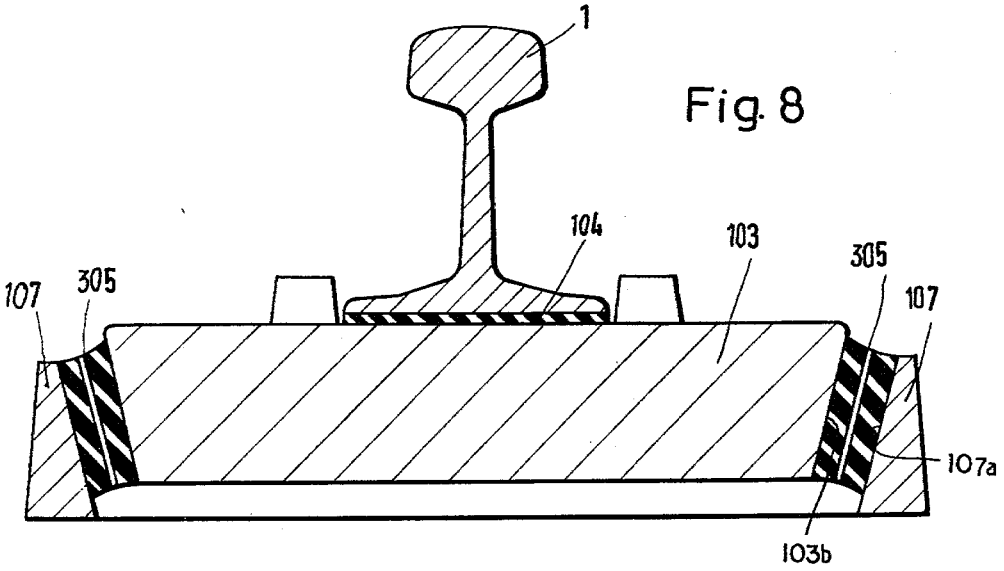
Fig. 8
Fig. 9
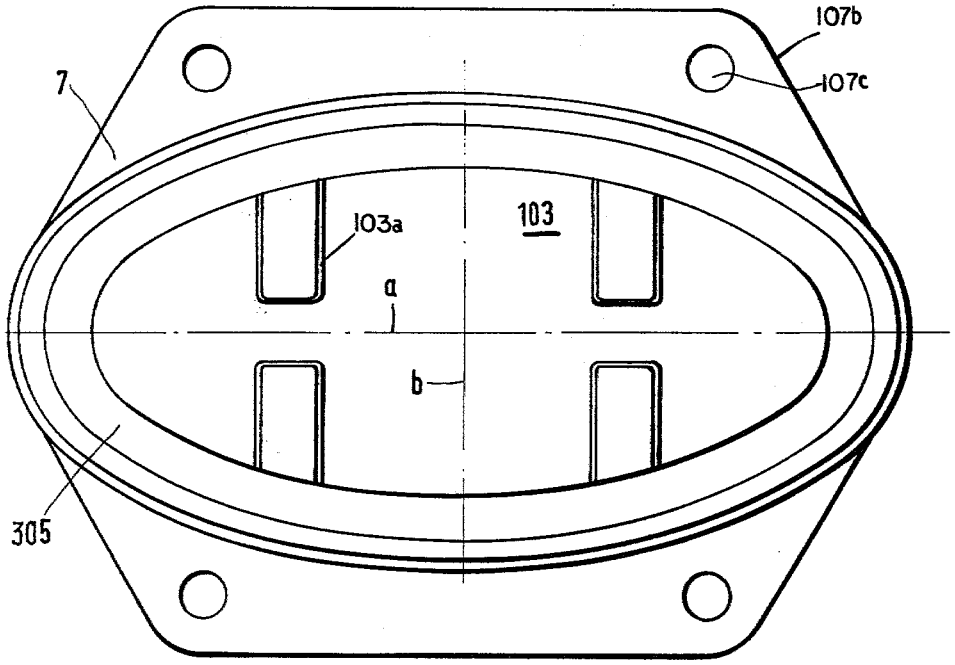

TRACK MOUNTING ASSEMBLY AND SOUND-DAMPING SYSTEM THEREFORE

FIELD OF THE INVENTION

Our present invention relates to a rail-support system for railway vehicles and, more particularly, to a sound-damping arrangement for the rail of a railway track.

BACKGROUND OF THE INVENTION

Railway right of ways are provided with a road bed of ballast into which sleepers or ties are set or, alternatively, as concrete beds to which the rails are anchored. The latter type of construction is of increasing importance for high-speed railway systems utilizing welded track or rails which are continuous over extremely long lengths. In concrete beds also, the rail is likewise fixed to sleepers which can be associated with sound-damping material to reduce the noise generated in the environment upon the passage of a vehicle.

Thus the rails rest upon the sleepers which rest, in turn, upon rigid bodies, e.g. a concrete slab, while between the rails and the sleeper and/or between the sleeper and the rigid body, elastic sound-damping intermediate rails are provided.

In conventional rail-mounting arrangements of the afore-described type, the elastic intermediate layer is disposed between the plate provided below the rail and the sleeper as described in German patent document—printed application (Auslegeschrift) No. 12 04 697. Alternatively, the elastic intermediate layer is provided between the sleeper and the concrete slab or plate overlying the ballast or subsurface of the road bed (see German patent document—Auslegeschrift No. 12 75 081), in the latter case further elastic layers being considered between the rail and the sleeper as well.

All of these conventional rail-mounting systems have the disadvantage that the elastic intermediate layer is subjected to compression to an extent that its elasticity is reduced so sharply that shock and vibration transmittal cannot be prevented, i.e. sound, in the form of noise, is generated or transmitted by the mounting.

OBJECTS OF THE INVENTION

It is the principal object of the present invention to provide a sound-damping rail system whereby the disadvantages of earlier arrangements are avoided.

Another object of the invention is to provide an improved sound-damping system for the rails of a railway track which has improved sound-damping properties and has a reduced propensity to generate or transmit noise in the form of vibration and shock.

Yet another object of the invention is to provide an improved arrangement for the purposes described which enables the sound-damping means to be readily removed and replaced.

SUMMARY OF THE INVENTION

These objects and others which will become apparent hereinafter, in accordance with the present invention, are attained by providing the sound-damping elements of a rail-mounting system (consisting of a rail which is affixed to a sleeper or other rigid support) with an inclined rubber-metal assembly in which the metal element is vulcanized or bonded to the rubber and which, because of the inclined configuration of the rubber and metal layers and their interface, causes the elastic member to be stressed with shear and pressure so as to create a relatively long distortion path under load whereby shock and vibration are precluded.

As a result of this construction, the elasticity of the resilient member remains effective over a long displacement of the two relatively displaceable members, say the rail and the rigid support body, so that the limits imposed by a strict compression-type sound-damper are eliminated.

It has also been found to be advantageous to use the inclined metal-rubber composite because it permits the angle of inclination to be adjusted to provide the desired degree of elasticity and yieldability. Naturally the angle of improvement in this respect is the angle included between the rubber rails or the aforementioned interface at which the rubber is bonded to the metal, and the vertical. The Shore hardness of the rubber layer also can be varied to establish this parameter and the parameter is also effected by the length of the rubber-metal assembly, i.e. the length of the elastomeric member measured parallel to the aforementioned interphase.

Because of the more effective damping of shock and vibration with the system of the present invention, the traveling comfort in a railway vehicle on the track is increased.

According to a feature of the invention, the rubber-metal support structure is so arranged that it or each rubber layer includes an angle between 5° and 85° with an imaginary vertical line.

According to yet another feature of the invention, the rubber-metal assembly is provided around the periphery of a support plate disposed below the rail and the elastomeric member, in turn, acts upon a support frame which bears against the rigid support member, e.g. a sleeper, underlying the rail. The support frame can have inwardly and downwardly inclined walls while the support plate can likewise have inwardly and downwardly inclined walls with the elastomeric member sandwiched between them.

This arrangement requires only that the rigid plate be raised slightly to permit the removal of the rubber-metal assembly and its replacement.

Naturally, the support frame may form part of the rubber-metal assembly, i.e. the elastomeric member can be bonded to the support frame or it may be formed as an independent unit. In either case, an inner downwardly and inwardly inclined metal frame member may form part of the assembly and can be engaged between downwardly and inwardly beveled flanks of the support plate. The support frame can, in addition, form part of yet another rubber-metal assembly.

According to yet another feature of the invention, the rubber-metal support structure is disposed at the periphery of a transversely extending sleeper and supports the latter upon longitudinally extending sleepers lying therebelow or upon a concrete slab. Alternatively, the rubber-metal member is provided on the periphery of downwardly extending projections on transverse sleepers to support the latter relative to the underlying longitudinal sleepers or the underlying rigid body, e.g. a concrete slab.

A highly effective sound-damping support for the rails can be achieved by providing the rubber-metal support device on in diametrically opposite regions of the periphery of the support plate or the transverse sleepers or their projections. According to another feature of the invention, the rubber-metal devices are formed with at least two shanks or legs inclined to one another in plan view. Both shanks or legs of the rubber-metal support should include angles with the rails between 5° and 85°.

The rail support system can be improved further by providing the support plate and the recess in the support frame of an oval configuration as seen from above. This configuration of the support plate and the opening in the support frame has the advantage that lateral forces or forces in the vertical-braking direction upon the rails are transformed in significant part into shear forces in the rubber of the rubber-metal support and only then to the support surface. Such forces arise especially at curves in the track.

The expression "oval configuration" is intended to encompass all curves forming an oval, i.e. parabolas, compound curves, cycloids, hyperbolas or the like. Advantageously, however, the support plate and the recess or opening in the frame and the configuration of an ellipse with the major axis forming a right angle to the rail. In this case the major axis should have a length which does not exceed three times the minor axis. Preferably the length of the major axis is twice that of the minor axis.

BRIEF DESCRIPTION OF THE DRAWING

The above and other objects, features and advantages of the present invention will become more apparent from the following description, reference being made to the accompanying drawing in which FIG. 1 is a vertical cross section through a rail support system having a rubber-metal device at the periphery of a support plate underlying the rail, in accordance with the present invention;

FIG. 2 is a longitudinal section through the rail support system in FIG. 1;

FIG. 8 is a vertical section through another embodiment of the invention transverse to the rail; and FIG. 9 is a plan view of the arrangement of FIG. 8 with the rail omitted.

SPECIFIC DESCRIPTION

Figure 3:
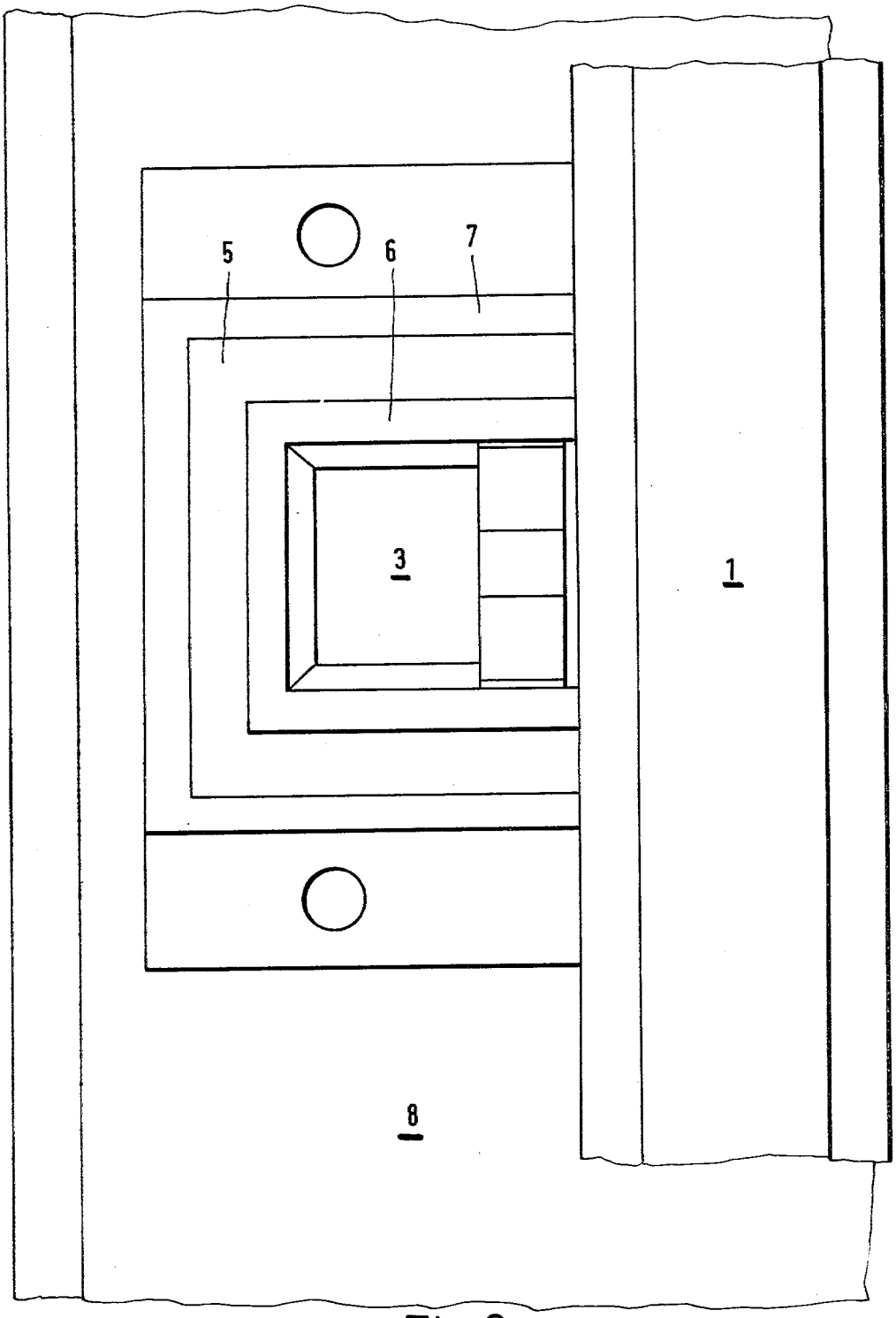
FIG. 3 is a plan view of the system shown in FIG. 1 in somewhat diagrammatic form.

The rail-mounting assembly shown in FIGS. 1 through 3 comprises a rigid body 8 in the form of a concrete slab into which a metal plate 9 is set in a recess 8*a* in the region of each mounting arrangement.

The rail 1 rests upon an elastomeric layer 4 of rubber and is anchored to a rigid, e.g. steel support plate 3 by a conventional holddown device represented at 2. The holddown device can include a bolt 2*a* fixed in the plate 3, a nut 2*b* bearing upon a lock washer 2*c* which, in turn, rests against a track clamp 2*d* engaging the flange of the rail 1.

At the periphery of the support plate 3, here serving as a sleeper if member 8 is not a sleeper but has an additional support element if member 8 is a sleeper, there is provided a rubber-metal support generally represented at 5. This rubber-metal support 5 can include a rubber layer 5*a* which can be bonded, i.e. vulcanized to a plate 6 which can be welded at 6*a* and 6*b* to the support plate 3 and is inclined to the vertical, a rubber layer 5*b* which can be bonded to a support frame 7 and, if desired, intermediate metal layers 5*c* (one shown) which can be vulcanized or otherwise bonded to the rubber layers 5*a* and 5*b*. Either the bond to the frame 7 or the bond to the plate 6 or both can be omitted. As can be seen in FIG. 3, member 6 forms an inner frame with a downwardly and inwardly inclined flank 6*c* while the outer frame 7 has an inner flank 7*a* which is downwardly and inwardly inclined, the inclination being to the vertical.

The frame 7 rests directly upon plate 9.

A further elastomeric layer 10 is provided below the support plate 3 to serve as an emergency stop when the gap G below the plate 3 and the layer 10 is taken upon loading of the rubber elastic member 5. Advantageously, the layer 10 is integral, i.e. formed in one piece with one of the rubber layers of member 5.

The frame 7, as can be seen in FIG. 3, has a rectangular opening with the frame 6 being geometrically similar thereto and member 5 being similarly rectangular. However, the member 5 can have, in plan view, a square or other polygonal shape if desired.

The member 5 and each of the frames 7*a*, 6*c* includes with the vertical an angle between 15° and 30°.

Figure 4:
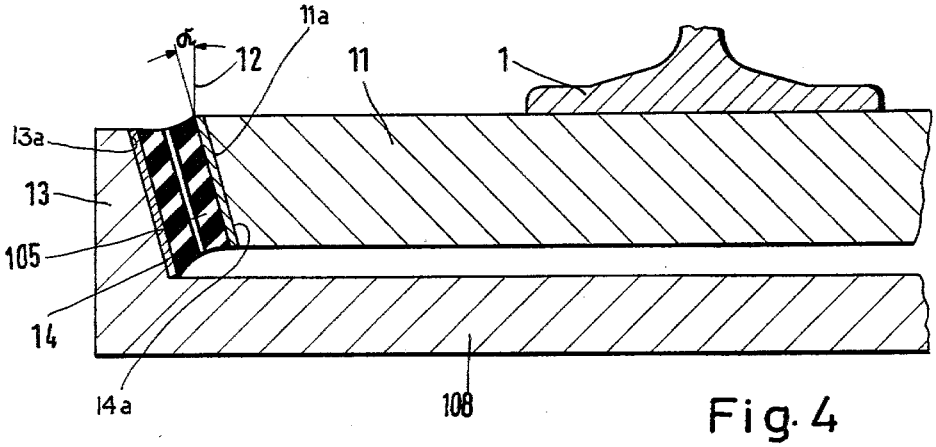
FIG. 4 is a vertical transverse cross-sectional view through a rail support system embodying another aspect of the invention.
Figure 5:
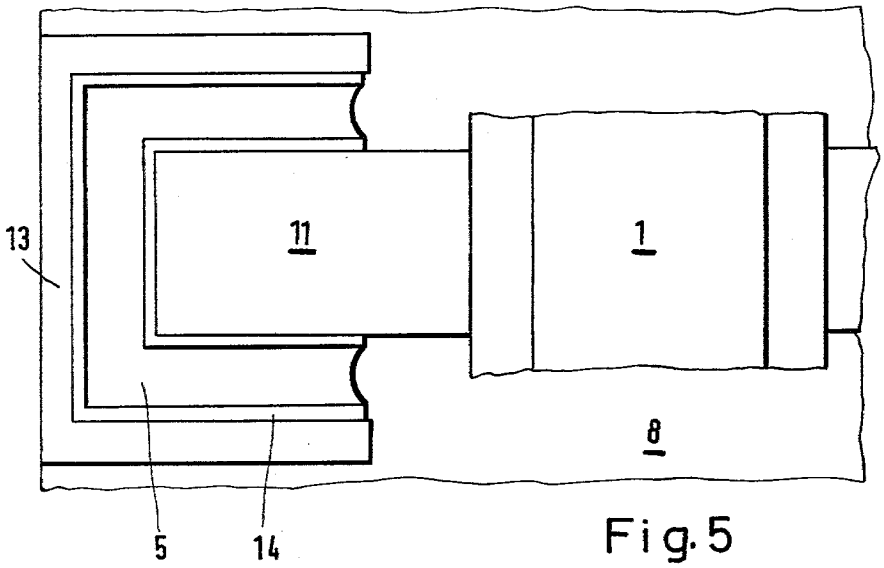
FIG. 5 is a plan view of the arrangement of FIG. 4.

In FIGS. 4 and 5, we have shown another sound-damping system embodying the present invention in which the rail 1 has been illustrated only partly and rests upon a transversely extending sleeper 11, being clamped thereto by conventional means not shown. In this embodiment, the sleeper 11 itself is formed with a downwardly and inwardly inclined flank 11*a* while the outer frame is formed by an upstanding projection 13 with a downwardly and inwardly extending flank 13*a*, of the overlying rigid body 108 which may be a longitudinal sleeper or a concrete slab. The rubber-metal support structure 105 is bounded by outer and inner plates 14, 14*a* which are vulcanized, to the rubber rails in the usual manner so that the interface between the rubber and a metal layer of the member 5 includes an angle $\alpha$ with an emergency vertical line 12. The value of the angle $\alpha$ can be between 5° and 85° but preferably is between 10° and 30°.

The plates 14, 14*a* are not bonded to the sleeper 11 or the projection 13, so that replacement of the member 105 can be effected by slight elevation of the sleeper 11.

Figure 6:
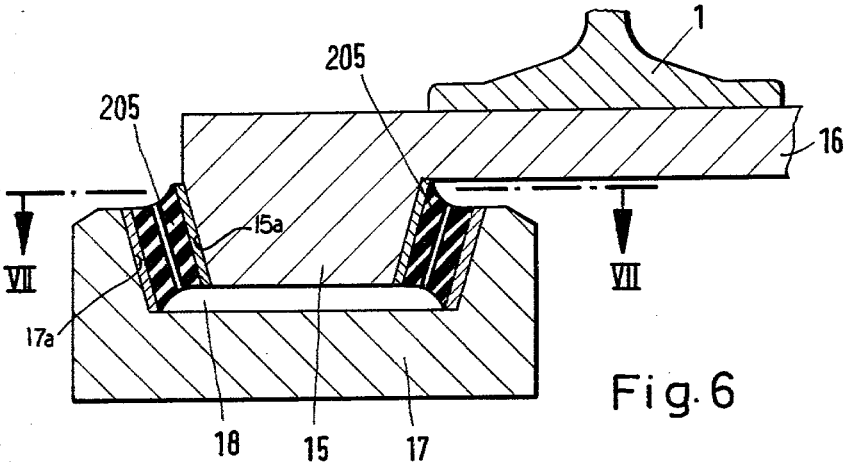
FIG. 6 is a view similar to FIG. 4 but illustrating another embodiment of the invention.
Figure 7:
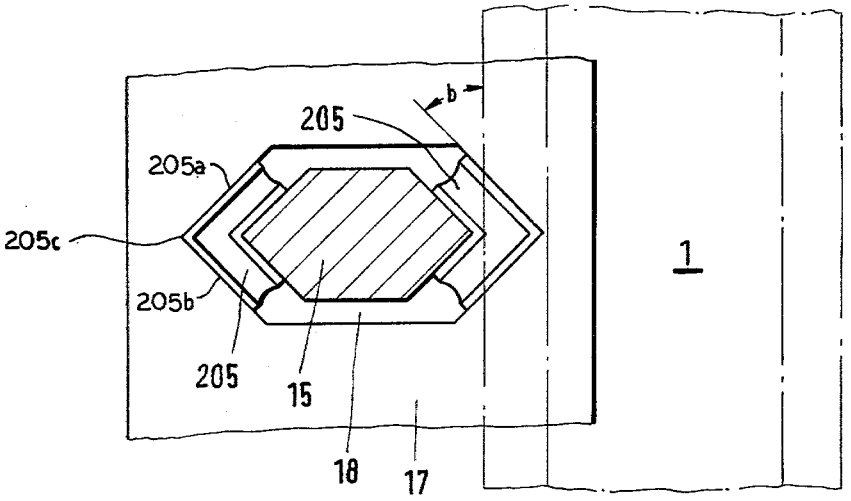
FIG. 7 is a section taken along the line VII—VII of FIG. 6.

FIGS. 6 and 7 show an embodiment of the invention in which a pair of diametrically opposite rubber-metal members 205 are disposed at diametrically opposite locations of a downwardly extending projection 15 from a transverse sleeper 16 carrying the rail 1 which has only been shown partly. In this case, the projection 15 is of hexagonal prismatic form and each of the members 205 is angular, i.e. has a pair of shanks 205*a*, 205*b* joining at a vertex 205*c*. The flanks 15*a* and 17*a* of the projection 15 and the recess 18 formed in a longitudinal sleeper 17, are inclined to the vertical downwardly and inwardly in the manner previously described. As can be seen in FIG. 7, moreover, the shanks 205*a* and 205*b* include angles b with the rail 1 which is illustrated in dot-dash lines. These angles can be between 0° and 85° but preferably range between 15° and 60°.

The rail mounting assembly of FIGS. 8 and 9 includes an oval support plate 103 (see in plan view) with upstanding projections 103*a* flanking the rail 1 and supporting the latter via the intermediary of an elastomeric cushion 104. The track clamps have not been illustrated in these FIGURES because they are conventional. The outer flank 103*b* of the oval support plate 3 is downwardly and inwardly inclined and confronts a geometrically similar downwardly and inwardly inclined flank 107*a* of a flank 107 which has laterally extending flanges 107*b* with holes 107*c* by which this frame can be anchored to a sleeper or other bedding slab of track. The rubber-metal member 305 here lies between the flanks and can be bonded to them or received between plates such as have been described at 14 and 14*a* previously. The major axis of the ellipses is represented at a and the minor axis at b. For the annular rubber-metal member 305, the ratio of the lengths of the major to the minor axis can be 2:1 to 3:1.

We claim:

1. A sound-damping mounting for a rail upon a rigid body, comprising:

a frame supported on said body and elongated in a direction transverse to said rail while lying below said rail, said frame being composed of rigid material and having elements forming a continuous periphery around an opening, at least some of said elements extending generally transverse to said rail, said elements having flanks including an angle with the vertical between 5° and 85° and inclined upwardly and outwardly;

a rigid member underlying said rail and having at least a portion received in said opening and of a shape geometrically similar to that of said opening with flanks parallel to the corresponding flanks of said opening but spaced therefrom;

at least one rubber-metal plural-layer sound-damping member disposed between the spaced apart flanks of said rigid member and said frame while bridging the space between them and having its layers inclined at said angle, said rubber-metal sound-damping member extending at least along the elements generally transverse to said rail; and means for securing said rail to said rigid member.

2. The sound-damping mounting defined in claim 1 wherein said frame and said opening extend beyond said rail to opposite sides thereof beneath said rail and said rigid member is a plate received in said opening.

3. The sound-damping mounting defined in claim 1 wherein said rigid member is a transverse sleeper and said rubber-metal member extends around the entire periphery of said sleeper.

4. The sound-damping mounting defined in claim 1 wherein said portion of said rigid member, said opening and said frame have an oval configuration.

5. The sound-damping mounting defined in claim 4 wherein said rigid member, said portion and said opening have the configuration of an ellipse as seen in plan view with a major axis perpendicular to the rail.

6. The sound-damping mounting defined in claim 5 where said major axis has a length at least twice the length of the minor axis of the ellipse but no greater than three times said minor axis.

* * * * *